US011679058B2

(12) United States Patent
Pepe

(10) Patent No.: US 11,679,058 B2
(45) Date of Patent: Jun. 20, 2023

(54) UNIVERSAL TIP ADAPTER

(71) Applicant: Thomas F. Pepe, Houston, TX (US)

(72) Inventor: Thomas F. Pepe, Houston, TX (US)

( * ) Notice: Subject to any disclaimer, the term of this patent is extended or adjusted under 35 U.S.C. 154(b) by 370 days.

(21) Appl. No.: 17/023,364

(22) Filed: Sep. 17, 2020

(65) Prior Publication Data

US 2021/0077340 A1 Mar. 18, 2021

Related U.S. Application Data

(60) Provisional application No. 62/901,264, filed on Sep. 17, 2019.

(51) Int. Cl.
*A61H 19/00* (2006.01)
*A61H 23/00* (2006.01)

(52) U.S. Cl.
CPC ..... *A61H 19/30* (2013.01); *A61H 23/00* (2013.01); *A61H 2201/0157* (2013.01); *A61H 2201/1685* (2013.01)

(58) Field of Classification Search
CPC ..... A61H 23/00; A61H 2201/0153; A61H 19/00; A61H 19/40; A61H 19/50; A61H 21/00
See application file for complete search history.

(56) References Cited

U.S. PATENT DOCUMENTS

2009/0234182 A1* 9/2009 Buchholz ..... A61H 19/00 705/40

* cited by examiner

*Primary Examiner* — Samchuan C Yao
*Assistant Examiner* — Tina Zhang

(57) ABSTRACT

A universal tip adapter for a handheld massage therapy product is disclosed. The universal adaptor comprises a rigid body having a first end and a second end. The first end is formed with an internally threaded cavity for screwing with an external thread on the end of a handheld massage therapy product via a universal hub. The second end is formed with external threads for screwing with an internal threading of a massager head and/or consumer accessories, thereby enabling a user to securely and simply connect the universal adaptor to different massage heads and other consumer accessories to the massage therapy product. The second end of the universal adaptor is an external threaded section. The second end is configured to securely connect to the massager head and/or consumer accessories via the external threads. The universal adaptor is further configured to securely and simply connect to sexual pleasuring accessories.

12 Claims, 7 Drawing Sheets

UNIVERSAL TIP ADAPTER

CROSS REFERENCE TO RELATED APPLICATION

The present application claims the benefit of U.S. Patent Application No. 62/901,264 filed Sep. 17, 2019, the contents of which is hereby incorporated by reference.

BACKGROUND OF THE INVENTION

A. Technical Field

The present invention generally relates to a universal tip adapter. More specifically, the present invention relates to a universal tip adaptor or connector for a massage therapy product, configured to enable a user to securely cross connect multiple (from product "A" to product "B") massage heads and other consumer accessories, for example, sexual pleasuring accessories, to the massage therapy product.

B. Description of Related Art

Handheld massagers for home use have become a very active field of inventions recently and are well known in the art. Such massagers include a handle attached to a massage head and driven by an electric motor with adjustments for intensity of the percussion or vibration. Currently, the handheld massagers are configured to use with a plurality of massage heads for providing different massaging effects and therapeutic experience for a user. The massage heads could be formed with different geometry and size, as well as differ in their material properties. The massage heads are configured to enable the user to removably affix to the handheld massager. For example, the massage heads may be formed with a protrusion for inserting into the cavity of the handheld massager, thereby affixing the massage heads to the handheld massager.

However, the wide variety of massage heads and other consumer accessories, for example, sexual pleasuring accessories, only securely affixing to the shaft or a node of the existing handheld massager and does not work on any other device. If the head is not secured properly to the massager then it may cause injuries to the user and also it could not provide efficient massage effect on the part of the user's body.

In light of the above-mentioned problems, there is a need for a universal tip adaptor or connector for a massage therapy product enabling the customer the benefit of using the best products and the best accessories in many combinations. Further, there is also a need for a universal tip adaptor or connector configured to enable a user to simply and securely connect multiple massage heads and other consumer accessories, for example, sexual pleasuring accessories, to the massage therapy product.

SUMMARY OF THE INVENTION

The present invention generally discloses a universal tip adaptor. Further, the present invention discloses a universal tip adaptor or connector for a massage therapy product, configured to enable a user to securely connect multiple massage heads and other consumer accessories, for example, sexual pleasuring accessories, to the massage therapy product.

In one embodiment, the universal tip adaptor is configured to enable a user to securely connect a massager head or powered tip to the powered shaft. In some embodiments, the universal tip adaptor could be used to connect the multiple massage heads and other consumer accessories, for example, sexual pleasuring accessories, to the massage therapy product. In one embodiment, the universal tip adapter could be interchangeable and used on all types of massagers and accessory tips. In one embodiment, the universal tip adapter is configured to removably affixed to an insertion point of the handheld massage therapy product. In one embodiment, the universal tip connector is configured to allow other massage products to utilize with other connected accessories and attachments both powered and passive technologies, for example, a heated tip and sexual pleasuring accessories or adult devices using a coupling member. The universal tip connector changes the connection point of the massage therapy product and to be able to accept a variation of attachments. In one embodiment, the universal tip adaptor can use our dual tip (lumbar/fork with ends/threads or adapters).

In one embodiment, the universal tip adaptor comprises a rigid body having a first end and a second end. In one embodiment, the first end is formed with an internally threaded cavity for screwing with an external thread on the end or an insertion point of a handheld massage therapy product. In one embodiment, the second end is formed with external threads for screwing with an internal threading of a massager head and/or consumer accessories, for example, sexual pleasuring accessories, thereby enabling the user to securely and simply connect the universal tip adaptor to a various type of massage heads and other consumer accessories to the massage therapy product.

In one embodiment, the first end could be a fastening section and the second end could be an external threaded section. In one embodiment, the second end is configured to securely connect to the massager heads and/or consumer accessories via the external threads. In one embodiment, the second end of the universal tip adaptor comprises m16 external threads and keeps this as an open end. In one embodiment, the universal tip adaptor is configured to engage and couple the various type of massage heads to the massage therapy product. In some embodiments, the universal tip adaptor is further configured to securely and simply connect to a sexual pleasuring accessory. In one embodiment, the first end of the universal tip adaptor has a diameter larger than the diameter of the second end. In one embodiment, the universal tip adaptor is made of a material includes, but not limited to composite, steel, iron, aluminum, and plastic.

In one embodiment, the first end is configured to engage and couple to an external thread on the end of a handheld massage therapy product using a universal hub. In one embodiment, the universal hub is configured to receive and accept the universal tip adaptor on both sides. In one embodiment, the universal hub comprises a cavity for receiving the universal tip adaptor on either side.

In one embodiment, a coupling member used to affix the sexual pleasuring accessory to the handheld massage therapy product. In one embodiment, the coupling member is configured to securely couple to the sexual pleasuring accessory to the second end of the universal tip adaptor. In one embodiment, the coupling member is made of, but not limited to, plastic and silicone. In one embodiment, the coupling member comprises a tip at one end and a sleeve, which is extended from the tip. In one embodiment, the tip is configured to securely couple or screw to the second end of the universal tip adaptor in order to connect the coupling member to the handheld massage therapy product. In one embodiment, the sleeve of the coupling member is made of but not limited too, silicone. In one embodiment, the coupling member is configured to enable the user to securely and simply connect the sexual pleasuring accessory by stretching and extending the sleeve over the surface of the sexual pleasuring accessory. The sleeve provides extremely tight fit in order to securely connect the coupling member to the sexual pleasuring accessory, thereby enabling the user to connect the sexual pleasuring accessory to the handheld massage therapy product using the coupling member via the universal tip adaptor. For example, the sexual pleasuring accessories such as, but not limited too, dildos, an ice ball, and thereof. The sleeve allows all objects to fit over and unraveled like a condom. The coupling member allows the user to attach any massage gun to any object.

In one embodiment, the user could securely connect various other consumer massagers or devices to the massager heads using the universal tip adaptor. The user able to use a wide array of TT Therapeutics accessories and again vice versa on other potentially powered devices or machines by attaching and using the universal tip adaptor and/or coupling member on to the potentially powered device. The universal tip adapter extends the ability to take the specialized accessories such as a TimTam accessory or various massager heads and extend them to more customers so that it could provide some type of therapy or relief for the users. In one embodiment, the universal tip adapter could be interchangeable and used on all types of massagers and accessory tips.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
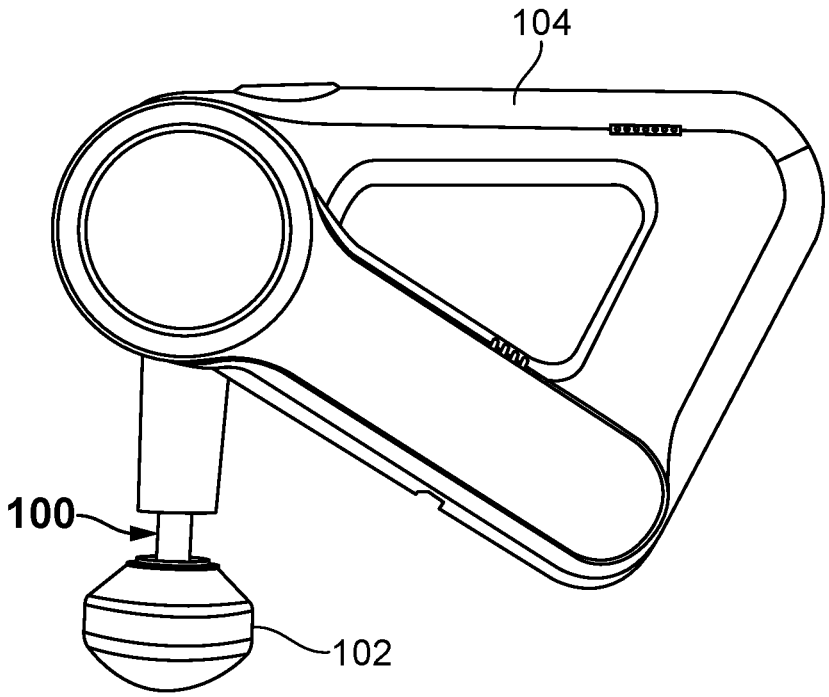
FIG. 1 shows a perspective view of a universal tip adaptor used for connecting a massager head to a massage therapy product in an embodiment of the present invention.
Figure 2:
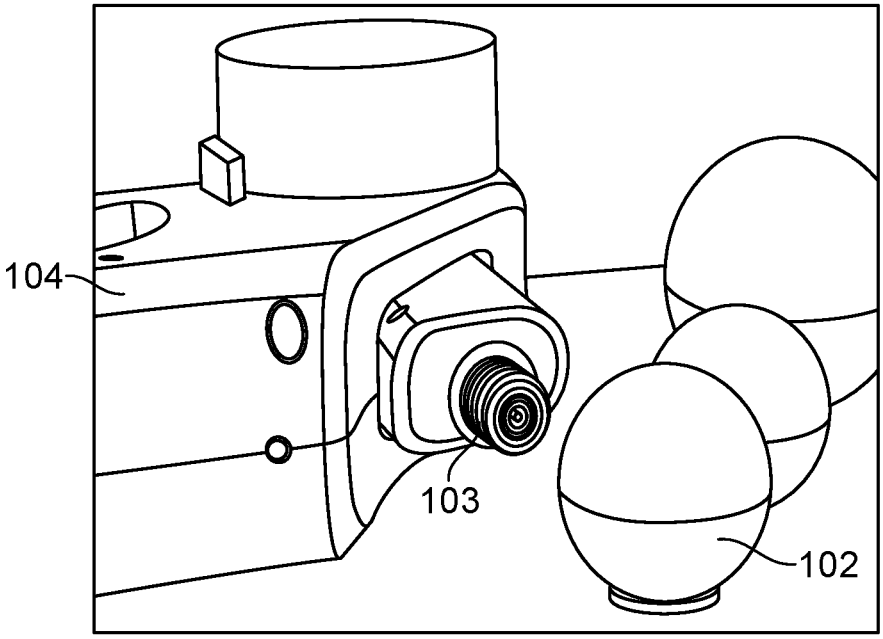
FIG. 2 shows a perspective view of the massage therapy product with the powered tip or massager head in one embodiment of the present invention.

Referring to FIGS. 1-2, a universal tip adaptor 100 used for connecting a massager head 102 to a massage therapy product 104 in one embodiment is disclosed. In one embodiment, the universal tip adaptor 100 is configured to enable a user to securely connect a massager head or powered tip 102 to the powered shaft 103. In some embodiments, the universal tip adaptor 100 could be used to connect the multiple massage heads (130, 132, 134, 136, 138, and 140) (shown in FIGS. 11-16) and other consumer accessories, for example, sexual pleasuring accessories, to the massage therapy product 104. In one embodiment, the universal tip adapter 100 could be interchangeable and used on all types of massagers and accessory tips. In one embodiment, the universal tip adapter 100 is configured to removably affixed to an insertion point of the handheld massage therapy product 104. In one embodiment, the universal tip connector 100 is configured to allow other massage products to utilize with other connected accessories and attachments both powered and passive technologies, for example, a heated tip and sexual pleasuring accessories or adult devices using a coupling member 118 (shown in FIG. 8). The universal tip connector 100 changes the connection point of the massage therapy product 104 and to be able to accept a variation of attachments. In one embodiment, the universal tip adaptor 100 can use our dual tip (lumbar with ends/threads).

Figure 3:
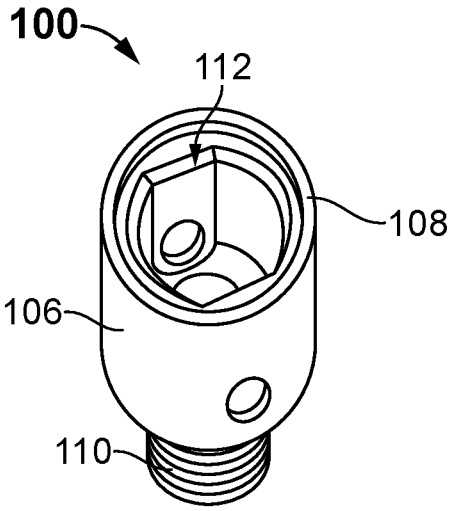
FIG. 3 shows a top perspective view of the universal tip adaptor in one embodiment of the present invention.
Figure 4:
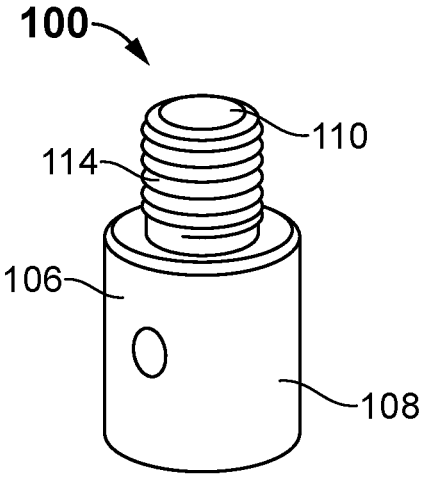
FIG. 4 shows a perspective view of the universal tip adaptor in one embodiment of the present invention.

Referring to FIGS. 3-4, the universal tip adaptor 100 of the present invention in one embodiment is disclosed. In one embodiment, the universal tip adaptor 100 comprises a rigid body 106 having a first end 108 and a second end 110. In one embodiment, the first end 108 is formed with an internally threaded cavity 112 for screwing with an external thread on the end or an insertion point of a handheld massage therapy product 104 (shown in FIG. 1). In one embodiment, the second end 110 is formed with external threads 114 for screwing with an internal threading of a massager head (102, 130, 132, 134, 136, 138, and 140) and/or consumer accessories, for example, sexual pleasuring accessories, thereby enabling the user to securely and simply connect the universal tip adaptor 100 to a various type of massage heads (102, 130, 132, 134, 136, 138, and 140) (shown in FIGS. 11-16) and other consumer accessories to the massage therapy product 104.

In one embodiment, the first end 108 could be a fastening section and the second end 110 could be an external threaded section. In one embodiment, the second end 110 is configured to securely connect to the massager heads (102, 130, 132, 134, 136, 138, and 140) and/or consumer accessories via the external threads 114. In one embodiment, the second end 110 of the universal tip adaptor 100 comprises m16 external threads and keeps this as an open end. In one embodiment, the universal tip adaptor 100 is configured to engage and couple the various type of massage heads (102, 130, 132, 134, 136, 138, and 140) (shown in FIGS. 11-16) to the massage therapy product 104. In some embodiments, the universal tip adaptor 100 is further configured to securely and simply connect to a sexual pleasuring accessory 124 (shown in FIG. 8). In one embodiment, the first end 108 of the universal tip adaptor 100 has a diameter larger than the diameter of the second end 110. In one embodiment, the universal tip adaptor 100 is made of a material includes, but not limited too, steel, iron, aluminum, and plastic.

Figure 5:
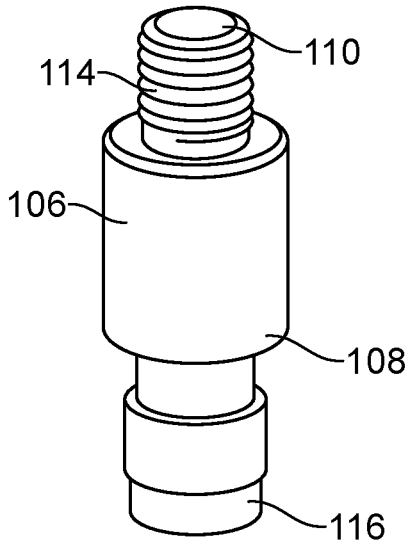
FIGS. 5-6 show perspective views of the universal tip adaptor configured to engage and couple to the massage therapy product using a universal hub in one embodiment of the present invention.
Figure 6:
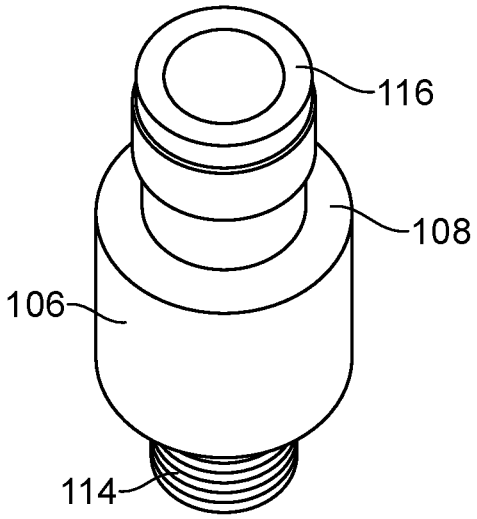

Referring to FIGS. 5-6, the universal tip adaptor 100 configured to engage and couple to the massage therapy product 104 using a universal hub 116 in one embodiment is disclosed. In one embodiment, the first end 108 is configured to engage and couple to an external thread on the end of a handheld massage therapy product 104 using a universal hub 116. In one embodiment, the universal hub 116 is configured to receive and accept the universal tip adaptor 100 on both sides.

Figure 7:
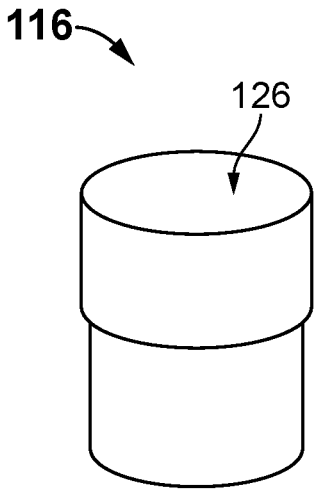
FIG. 7 shows a perspective view of the universal hub in one embodiment of the present invention.

Referring to FIG. 7, the universal hub 116 in one embodiment is disclosed. In one embodiment, the universal hub 116 is configured to receive and accept the first end 108 of the universal tip adaptor 100. In one embodiment, the universal hub 116 comprises a cavity 126 for receiving the universal tip adaptor 100 on either side.

Figure 8:
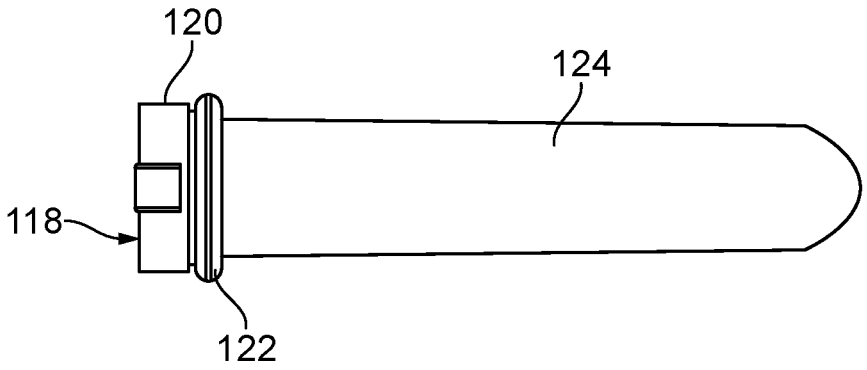
FIG. 8 shows a perspective view of a coupling member used to affix the sexual pleasuring accessory to the handheld massage therapy product in one embodiment of the present invention.
Figure 9:
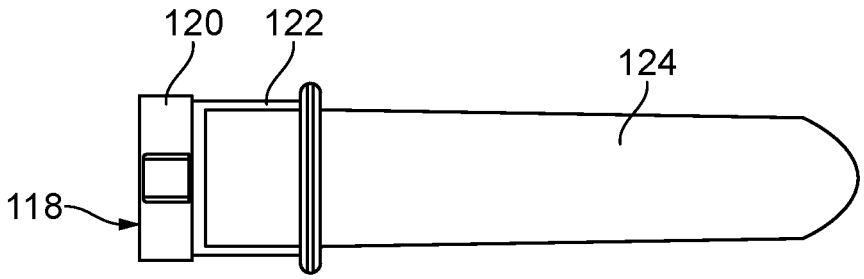
FIG. 9 shows a side perspective view of a sleeve of the coupling member extending from a tip and stretching over the sexual pleasuring accessory in one embodiment of the present invention.
Figure 10:
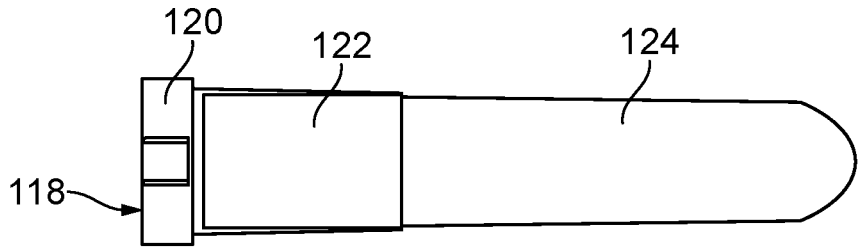
FIG. 10 shows a side perspective view of the sleeve of the coupling member inextended position over the sexual pleasuring accessory in one embodiment of the present invention.
Figure 11:
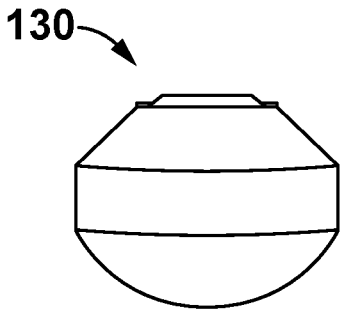
FIGS. 11-16 show perspective views of various massager heads used with the handheld massage therapy product in one embodiment of the present invention.
Figure 12:
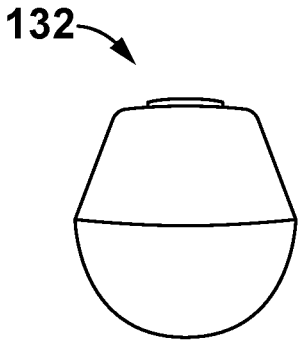
Figure 13:
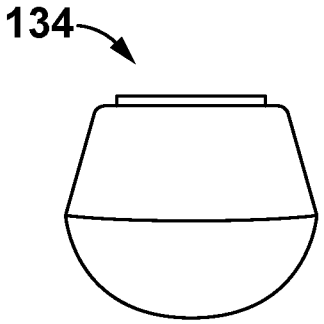
Figure 14:
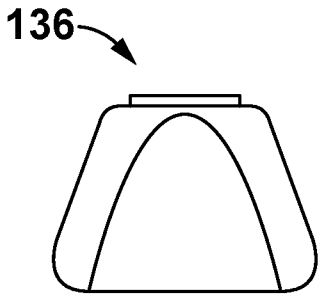
Figure 15:
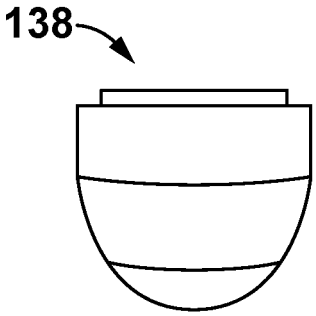
Figure 16:
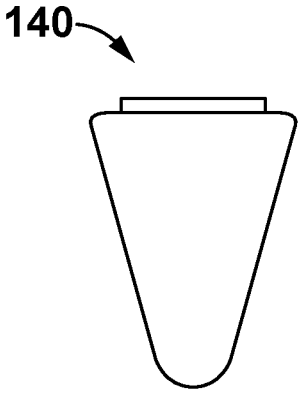

Referring to FIGS. 8-10, a coupling member 118 used to affix the sexual pleasuring accessory 124 to the handheld massage therapy product 104 in one embodiment is disclosed. In one embodiment, the coupling member 118 is configured to securely couple to the sexual pleasuring accessory 124 to the second end 110 of the universal tip adaptor 100. In one embodiment, the coupling member 118 is made of, but not limited to, plastic and silicone. In one embodiment, the coupling member 118 comprises a tip 120 at one end and a sleeve 122, which is extended from the tip 120. In one embodiment, the tip 120 is configured to securely couple or screw to the second end 110 of the universal tip adaptor 100 in order to connect the coupling member 118 to the handheld massage therapy product 104. In one embodiment, the sleeve 122 of the coupling member 118 is made of, but not limited too, silicone. In one embodiment, the coupling member 118 is configured to enable the user to securely and simply connect the sexual pleasuring accessory 124 by stretching and extending the sleeve 122 over the surface of the sexual pleasuring accessory 124. The sleeve 122 provides extremely tight fit in order to securely connect the coupling member 118 to the sexual pleasuring accessory 124, thereby enabling the user to connect the sexual pleasuring accessory 124 to the handheld massage therapy product 104 using the coupling member 118 via the universal tip adaptor 100. For example, the sexual pleasuring accessories such as, but not limited to, dildos, an ice ball, and thereof. The sleeve 122 allows all objects to fit over and unraveled like a condom. The coupling member 118 allows the user to attach any massage gun to any object.

Referring to FIGS. 11-16, various massager heads (130, 132, 134, 136, 138, and 140) of the handheld massage therapy product 104 is disclosed. In one embodiment, the user could securely connect various other consumer massagers or devices to the massager heads (130, 132, 134, 136, 138, and 140) using the universal tip adaptor 100. The user able to use a wide array of TT Therapeutics accessories and again vice versa on other potentially powered devices or machines by attaching and using the universal tip adaptor 100 and/or coupling member 118 on to the potentially powered device. The universal tip adapter 100 extends the ability to take the specialized accessories such as a TimTam accessory or various massager heads (102, 130, 132, 134, 136, 138, and 140) and extend them to more customers so that it could provide some type of therapy or relief for the users. In one embodiment, the universal tip adapter 100 could be interchangeable and used on all types of massagers and accessory tips.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A system comprising a universal tip adapter, a universal hub and a coupling member, universal tip adapter comprising:

a rigid body having a first end and a second end, wherein the first end is formed with an internally threaded cavity for screwing with an external thread on the end of a handheld massage therapy product via the universal hub, wherein the second end is formed with external threads for screwing with an internal threading of a massager head and/or sexual pleasuring accessories, thereby enabling a user to securely and simply connect the universal tip adaptor to a various type of massage heads and sexual pleasuring accessories to the massage therapy product, and wherein the universal tip adaptor is further configured to securely and simply connect to sexual pleasuring accessories using the coupling member, wherein the coupling member having a tip and a sleeve, wherein the tip is configured to securely couple or screw to the second end of the universal tip adaptor, and the coupling member is configured to enable the user to securely and simply sleeve over the surface of the sexual pleasuring accessory, thereby enabling the user to connect the sexual pleasuring accessory to the handheld massage therapy product using the coupling member via the universal tip adaptor.

2. The system of claim 1, wherein the first end is a fastening section and the second end is an external threaded section.

3. The system of claim 1, wherein the second end is configured to securely connect to the massager head and/or consumer accessories via the external threads.

4. The system of claim 1, is configured to engage and couple the various type of massage heads to the massage therapy product.

5. The system of claim 1, wherein the first end of the universal tip adaptor has a diameter larger than the diameter of the second end.

6. The system of claim 1, is made of a material that comprises of either composite, steel, iron, aluminum or plastic.

7. The system of claim 1, wherein the universal hub is configured to receive and accept the universal tip adaptor on both sides.

8. A system comprising a universal tip adapter and a coupling member, universal tip adapter comprising a rigid body having a fastening section on one end, configured to couple to an external thread on the end of a handheld massage therapy product;

an external threaded section on the other end, configured to couple to an internal threading of a massager head and/or sexual pleasuring accessories via external threads, thereby enabling a user to securely and simply connect the universal tip adaptor to a various type of massage heads and sexual pleasuring accessories to the handheld massage therapy, and wherein the universal tip adaptor is further configured to securely and simply connect to sexual pleasuring accessories using the coupling member, wherein the coupling member having a tip and a sleeve, wherein the tip is configured to securely couple or screw to the second end of the universal tip adaptor, and the coupling member is configured to enable the user to securely and simply connect the sexual pleasuring accessories by stretching and extending the sleeve over the surface of the sexual pleasuring accessory, thereby enabling the user to connect the sexual pleasuring accessory to the handheld massage therapy product using the coupling member via the universal tip adaptor.

9. The system of claim 1, wherein the fastening section on one end is formed with an internally threaded cavity for screwing with an external thread on the end of the handheld massager product.

10. The system of claim 1, is configured to engage and couple the various type of massage heads to the massage therapy product.

11. The system of claim 1, wherein the fastening section on one end of the universal tip adaptor has a diameter larger than the diameter of the external threaded section.

12. The system of claim 1, is made of a material that comprises of either steel, iron, aluminum, or plastic.

* * * * *